United States Patent [19]

Carter et al.

[11] Patent Number: 4,640,724

[45] Date of Patent: Feb. 3, 1987

[54] METHODS OF PRIMING EXPLOSIVE DEVICES

[75] Inventors: George B. Carter, Lichfield; Alan P. Manby, Amington, both of England

[73] Assignee: IMI Kynoch Limited, Birmingham, England

[21] Appl. No.: 245,972

[22] Filed: Mar. 20, 1981

[30] Foreign Application Priority Data

Apr. 19, 1980 [GB] United Kingdom ..... 8012963

[51] Int. Cl.[4] ..... C06B 41/06; F42B 33/02

[52] U.S. Cl. ..... 149/109.6; 86/1.1; 86/10; 86/17; 86/32; 86/33; 102/204; 149/28; 149/62; 264/3.1

[58] Field of Search ..... 86/1 R, 10, 17, 23, 86/22, 32, 33, 1.1; 149/26, 27, 28, 62, 109.6; 264/3 R, 3 D; 102/204, 469, 470.1

[56] References Cited

U.S. PATENT DOCUMENTS 2,350,556 7/1944 Hotchkiss ..... 86/10
4,247,494 1/1981 Carter ..... 149/26

FOREIGN PATENT DOCUMENTS 1578099 4/1971 Fed. Rep. of Germany .
7610074 1/1979 Netherlands ..... 86/10
1201565 8/1970 United Kingdom .
1569874 7/1980 United Kingdom ..... 149/26

*Primary Examiner*—John F. Terapane
*Assistant Examiner*—Howard J. Locker
*Attorney, Agent, or Firm*—Cushman, Darby & Cushman

[57] ABSTRACT

The invention provides a method of priming a blank or bulleted rimfire cartridge comprising the steps of (a) dosing into the rimfire case a quantity of a substantially dry, powdery, relatively insensitive premix comprising, in predetermined proportions, at least two materials that will, in the presence of a liquid reaction medium, react together forming a primary explosive compound, (b) compacting the premix so as substantially to fill the rim of the case therewith, (c) dosing a quantity of the liquid reaction medium into the case so as to cause said materials to react together forming the primary explosive compound and (d) drying the primer. By compacting the premix into the rim before the addition of the liquid reaction medium, the conventional spinning step may be dispensed with, thereby making the priming process safer and more economic.

11 Claims, 4 Drawing Figures

METHODS OF PRIMING EXPLOSIVE DEVICES

BACKGROUND OF THE INVENTION

This invention relates to the priming of explosive devices, more particularly rimfire cartridges, for example 0.22 rimfire cartridges.

By far the most common method of priming rimfire cartridges comprises dosing a predetermined amount of wet priming composition into respective, empty rimfire cartridge cases and then forcing the wet priming composition into the rim of each case using a rapidly rotating so-called "spinning punch". The cases are then passed to an oven in which the priming composition is dried and they are subsequently loaded with propellant and, in the case of live rounds, bulleted. That method has been practised for many years and is well-known to those skilled in the art. An alternative well-known but less commonly used method is that known as "dry heading". Both methods are extremely hazardous, inter alia, because they involve the handling, either wet or dry depending on the method used, of bulk primary explosives, for example lead styphnate, and of bulk priming compositions containing such primary explosives. The spinning process, too, has its disadvantages, particularly cost disadvantages, as it is necessary frequently to replace the punches because they wear rapidly.

In our British Pat. No. 1 569 874 the disclosure of which is incorporated herein by reference, we describe and claim a method of substantially mitigating the hazards of priming explosive devices, including rimfire cartridges. In that specification, we describe, inter alia, an improved, relatively safe method of priming rimfire cartridges comprising the steps of (a) dosing an amount of a substantially dry, relatively insensitive, premix into each, empty, cartridge case, the premix containing components that will, in the presence of a liquid reaction medium such as water, react together forming a highly sensitive primary explosive compound and further containing one or more ingredients intended to form part of the priming composition, (b) dosing a quantity of said liquid reaction medium into each case whereupon the said components react forming the primary explosive compound, (c) forcing at least some of the resulting wet priming composition into the cartridge rims and (d) drying the composition. Step (b) may be carried out before step (a), although it is preferred first to dose the premix into the cases followed by addition of the liquid reaction medium. By way of example, the premix may contain in predetermined quantities, as said components, styphnic acid and lead oxide which, in the presence of water as the reaction medium, react forming lead styphnate and, as said ingredients, an oxidiser such as bariumnitrate, a small proportion of sensitiser such as tetrazene and a frictionator such as powdered glass. Conveniently the premix may be made up in relatively large batches followed by dosing thereof into the cases and because it is relatively insensitive (because it does not contain lead styphnate as do the compositions usually used in conventional priming processes), it can be safely handled in bulk even though dry. This means, in particular, that the actual step of providing the priming composition in the case before spinning can be carried out using automated machinery which, in the conventional priming methods is not practically possible because of the dangers involved in handling bulk priming compositions. By way of explanation the sensitivity mentioned above and hereinafter in relation to the premix refers to the tendency of the whole of a substantially unconfined mass thereof to explode or rapidly deflagrate as a result of application of heat, friction, shock or electrostatic sparks to any part of the mass. Thus, the premix should have relatively little, or no, such tendency particularly when handled, either by hand or machinery, under normal factory conditions compared with certain primary explosive compounds such as lead styphnate, and compositions containing them, which have a very high such tendency, especially when dry.

The dry premix may, however, contain small amounts, for example up to 10%, of certain sensitive materials such as tetrazene which, although dangerous when dry and substantially unadulterated are sufficiently diluted by other relatively insensitive materials of the premix that the premix is safe to handle in bulk.

Steps (c) and (d) mentioned above are, as has already been indicated, conventional in the art and step (c) entails the use of conventional spinning with the inherent disadvantages mentioned above.

It is an object of the present invention to improve the method described in our above-identified earlier specification, in so far as it relates to the priming of rimfire cartridges. In particular it is an object of the invention to obviate the need to use high speed rotating spinning punches for forcing the priming composition into the rims of rimfire cartridge cases.

SUMMARY OF THE INVENTION

According to the present invention a method of priming a rimfire cartridge comprises the steps of:

(a) dosing into the rimfire cartridge case a predetermined quantity of substantially dry, homogeneous, powdery and relatively insensitive premix comprising components that do not react together in the premix but that will, in the presence of a liquid reaction medium, react forming a primary explosive compound, (b) compacting the premix so as substantially to fill the rim of the cartridge case therewith, (c) dosing a predetermined quantity of said liquid reaction medium into the case, and then (d) causing or allowing the material in the case to dry.

The premix may, in the case of certain primary explosive compounds, consist only of said components, ie the eventual priming explosive will consist of only the primary explosive compound together with any residual by-product of the reaction between the components. Usually, however, it will also contain one or more ingredients intended to form part of a priming composition. Examples of such ingredients have already been given above.

In this specification the term "component" refers to a material which will, in the presence of a suitable reaction medium, chemically react with at least one other "component" forming a primary explosive compound and "ingredient" refers to a material which remains substantially chemically unchanged during the reaction of the components, and which, therefore, if present in the premix will be present as such in the final priming composition.

Whilst the only specific primary explosive compound mentioned above is lead styphnate, which is the compound most commonly employed in the priming of rimfire cartridges, alternative primary explosive compounds may be utilized as will be apparent to those skilled in the art.

The liquid medium needs, of course, to be suited to the reaction in question, and should be volatilisable upon the application thereto of moderate heat. Preferably, it is water or at least waterbased. The reaction between lead oxide and styphnic acid, for example, readily occurs in the presence of a medium consisting substantially wholly of water.

In a modification of the method of this invention at least one, but not all of the components and/or at least one of the ingredients may, where appropriate, be contained in the liquid reaction medium either as a solution or suspension therein.

Dosing of the premix and liquid reaction medium into the rimfire cartridge case may be carried out using dosing machinery adapted to dispense the relatively small quantities required in the context of the invention. As an example, a 0.22 rimfire cartridge case typically requires from about 20 to 30 milligrams of priming composition; that is to say that premix dosing machinery needs to be capable of fairly accurately dispensing amounts of that order of size. The corresponding amount of liquid reaction medium required will be of the order, for example, of a few microliters, for example, from about 3 to 6 microliters. Advantageously, the dosing machinery is capable of dispensing the required quantity of premix or liquid reaction medium to a large number of cartridge cases simultaneously or in rapid succession. The method of the invention may thus be utilised in commercial operations that require to produce a large number, typically millions, of cartridges per week. An example of suitable dosing machinery is illustrated in the accompanying drawings.

The compaction step (b) of the method of the invention in effect replaces the conventional spinning step and may be effected using a suitably profiled punch. Advantageously, compaction is carried out in two stages preferably after having evenly distributed the dose of premix over the base of the cartridge case. Such even distribution may be achieved by a vibration or tapping operation. The first stage of the preferred compaction step utilizes a generally cylindrical punch having a radiused head and an external diameter slightly less than the internal diameter of the case. For example, in the case of 0.22 cartridge cases, the external diameter of the punch may be about 0.2". Compaction is effected by inserting the punch into the case and applying an axial load thereto, for example within the range of from 40 to 100 Kgs, the radiused surface of the punch forcing at least some of the premix into the rim and forming a fillet thereof around the periphery of the case bottom adjacent to the rim. Rotation of the punch is not necessary, but may be effected if desired in which case lower axial loads may be used, for example from 2 to 5 Kgs. For example, the punch may be rotated slowly, for example at a rate of one revolution per 1–2 seconds, through one or more revolutions in either or both directions. This produces especially good distribution of the premix with minimal punch wear.

The second stage of the preferred compaction step utilizes a generally cylindrical punch having a flat head and further compaction is effected by applying an axial load thereto, typically of the order of 130 Kgs. Again, rotation of the punch is unnecessary. In the second stage, the previously formed fillet of premix is crushed thereby improving packing, of the premix in the rim. It is to be understood that it is not necessary to compact all of the premix into the rim. Indeed, after effecting the compaction step just described, some of the premix will be present as a thin, compact layer covering substantially the whole of the base of the cartridge case.

In both stages, the punches are preferably made of polished, hardened steel although it would be possible to use punches made of alternative, relatively wear-resistant material. The design of the punches, and the compaction loads required, will depend largely on the physical nature of the premix and the above figures are given as a guide only. Optimum conditions may be determined by simple experiment.

After addition of the liquid reaction medium, it has been found beneficial to subject the cartridge case to a reduced pressure which enhances impregnation of the compacted premix with the liquid reaction medium thereby ensuring that substantially the whole quantity of the components undergoes the required reaction forming the primary explosive compound. For example, the cases may be subjected to an evacuation/air admission cycle in a suitable enclosure.

While the premix is still wet, ie before the drying step, we have found that it is preferable to add to the cartridge case a small quantity of a suitable varnish or other coatant that will form a thin film over the priming composition. Such a film serves to prevent spillage of priming composition from the cases during subsequent handling and improves the mass explosibility properties of the cases. A preferred coatant is shellac which may be dosed as a solution thereof in industrial methylated spirits into the cartridge cases using an apparatus similar to that used to dose the liquid medium. A preferred solution consists of approximately 25%wt for volume and an adequate film forms after a short period of standing in a ventilated drying rack.

In an alternative method, a coatant may be contained in the liquid reaction medium itself, for example as a dispersion therein. Examples of suitable coatants that can be dispersed in the preferred reaction medium, namely water, are certain acrylic polymers, for example Texicryl 13-205 supplied by Scott Bader. If the coatent is provided by this method, the evacuation step is preferably omitted as it will tend to disturb the film of coatant that forms over the priming composition. Needless to say, the coatant film should be permeable to water vapour to permit drying of the priming composition.

The last step of the method of the invention, ie the drying stage, may be carried out using, for example, an oven or drying room as is conventional.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figure 1:
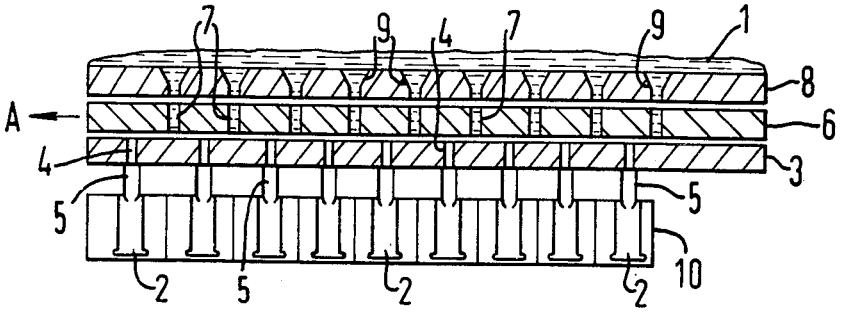
FIG. 1 is a schematic view, partly in section, of apparatus for dosing premix simultaneously into a plurality of rimfire cartridge cases.

Referring to FIG. 1 of the drawings, an apparatus for dosing a predetermined quantity of a substantially dry premix 1 of components and ingredients simultaneously into each of a large number of rimfire cartridge cases 2 comprises a lower fixed plate 3 containing, for example, an array of 500 holes 4 and nozzles 5, an intermediate movable plate 6 having an array of 500 holes 7 and an upper fixed plate 8 having a similar array of 500 holes 9. The empty cartridge cases 2 are contained in a vertical position in a tray 10 positioned below the plate assembly. The holes in the upper plate 8 and in the plate 6 are in register with one another but initially, as shown in FIG. 1, the holes 4 in the lower plate 3 are out of register therewith, the unapertured portions of the lower plate 3 closing the bases of the holes 7 in intermediate plate 6. With the plates in this position, a quantity of homogeneous, substantially dry premix 1 is raked over the upper surface of the plate 8. The holes 7 in plate 6 therefore become filled with premix, the amount of premix depending on the volume of these holes. The plate 6 is then slid laterally in the direction of arrow A to bring its holes 7 into register with the holes 4 in plate 3 and with the mouths of the empty cartridge cases 2 whereupon the measured quantity of premix contained within the holes 7 falls through the holes 4 in plate 3 and thence through respective nozzles 5 into the cartridge cases 2. The process may then be repeated using a fresh set of empty cartridge cases, after having moved the plate 6 back to its initial position.

In preferred embodiments, the plate assembly and a premix raking device form part of a module that can be automatically lowered to position the ends of the nozzles 5 just inside the empty cases 2 and then raised to leave the nozzles clear of the cases 2 after premix has been dosed thereinto. Preferably also, actuation of the intermediate plate 6 is automated as is the feed and raking of the premix 1. After dosing the premix 1 into the cases 2, the premix may, if desired, be evenly distributed over the bases of the cases by vibrating the tray 10.

Figure 2:
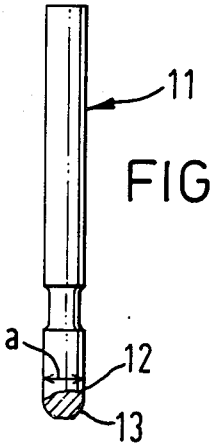
FIG. 2 is a side elevation, partly in longitudinal section, of a punch for use in a first premix-compaction stage.

Referring to FIG. 2, there is shown a generally cylindrical punch 11 for use in the first stage of a premix-compaction step. The lower portion 12 of the punch has a radiused surface 13 which, when the punch is lowered into a rimfire case containing premix, tends to force the premix towards and into the rim thereof. It has been found that the application to the punch 11 of a load from 40 to 100 Kgs is sufficient to give the desired compaction although, as already explained, lower loads may be used and, in certain circumstances, higher ones may be used. Preferably, the punch is made of hardened mild steel and the lower end thereof is preferably polished. In the case of 0.22 rimfire cases, the dimension a of the punch 11 is preferably about 0.2" and the radiused surface 13 has a radius of about 0.065".

Figure 3:
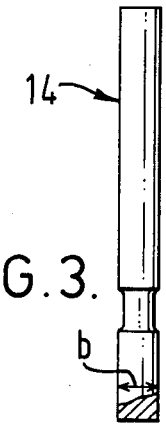
FIG. 3 is a side elevation, partly in longitudinal section, of a punch for use in a second premix compaction stage.

Referring to FIG. 3, there is shown a generally cylindrical punch 14 for use in the second stage of a premix-compaction step. Here, the punch is a simple flat one and the application of a force of the order of 130 Kgs is suitably applied thereto. As in the first compaction stage, however, higher or lower loads may be used as appropriate. In the case of 0.22 cartridge cases, the dimension b is preferably about 0.198". Again, it is preferably made of hardened mild steel and is polished at its lower end.

In each compaction stage, a single punch 11 (or 14) may be used successively to compact the premix. Alternatively, in a preferred embodiment, a large number of punches, for example mounted in a support plate, is used simultaneously to compact the premix in a corresponding number of cases which may be supported, during compaction, in the tray 10. Again, the compaction stages are preferably automated.

Figure 4:
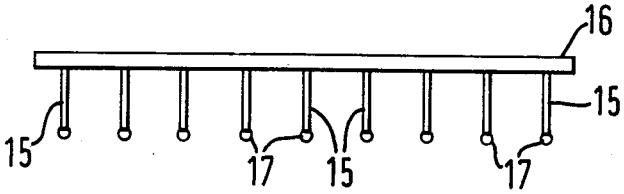
FIG. 4 is a schematic elevation of an apparatus suitable for dosing liquid reaction medium simultaneously into a plurality of rimfire cartridge cases.

After compaction of the premix, a quantity of liquid reaction medium, for example water, is then dosed into each rimfire case. In FIG. 4 there is shown an apparatus suitable for dosing the small amount of liquid required, typically a few microliters, simultaneously into a number of rimfire cartridge cases. The apparatus comprises a plurality of pegs 15 mounted in a support plate 16, the pegs being in an array corresponding to the array of cases 2 in the tray 10 of FIG. 1. As a first step, the pegs 15 are lowered into a tray (not shown) containing water or other reaction medium and are then withdrawn, whereupon a droplet 17 attaches itself to each peg. The size of the droplet is determined inter alia by the rate of withdrawal of the pegs 15, the surface area of the immersed portion of each peg and the viscosity/surface tension of the medium. The surface tension of the medium may be adjusted by the addition of a suitable agent such as a surfactant or an alcohol. The pegs 15 are then lowered into respective cases 2 containing premix until the pegs, or at least the droplets 17, touch the respective bases of the cases 2. Each droplet is then absorbed by the premix. The pegs 15 are then withdrawn from the cases 2 and the process repeated on a fresh set of cases 2.

After addition of the liquid reaction medium, the cases are preferably subjected to reduced pressure for the reasons described above.

The premix, while wet, may then be dosed with a small quantity of varnish that is preferably in the form of shellac dissolved in methylated spirit. The varnish may be dosed using an apparatus similar or identical to that shown in FIG. 4. The cases are then allowed to stand in the tray 10 for a short period of time, for example about ten minutes, during which the varnish solidifies sufficiently to provide a film over the priming composition which serves, inter-alia, to improve the mass explosibility properties of the primed cases and also permits the cases to be handled in bulk in any orientation without the occurrence of spillage of priming composition therefrom. The primed cases are then transferred to boxes in which they are dried in a steam-heated drying room or oven. In the case of 0.22 rimfire cartridges, a drying time of about two hours at about 40°-60° C. will normally be sufficient, although longer drying times may be necessary for bulk drying.

Rimfire cartridges primed in accordance with the method just described may then be further processed in the usual way.

The following Example illustrates the invention:

A substantially dry, homogeneous premix containing the following materials was made up in a quantity sufficient to prime several tens of thousands of 0.22 rimfire cartridges:

| | |
|---|---|
| COMPONENTS | |
| Styphnic Acid | 24.9% by wt |
| Lead Monoxide | 23.0% by wt |
| INGREDIENTS | |
| Tetrazene | 4.6% by wt |

-continued

| | |
|---|---|
| Barium Nitrate | 22.4% by wt |
| Ground Glass | 25.0% by wt |
| Blue Pigment | 0.1% by wt |

The tetrazene sensitiser, which is classified as a primary explosive compound, is dangerous in a dry, unadulterated state, but is safe to handle when wet. It is, therefore, preferably incorporated into the premix by mixing it wet with the glass and lead monoxide to give a wet paste, the mixture then being dried and powdered to give an almost insensitive powder which is then mixed with the remaining dry materials of the premix. Because of the considerable dilution of the dry tetrazene ingredient in the premix the dry premix is relatively insensitive and can be safely handled in bulk manually or by machinery.

About 30 mg of the dry premix were then dosed into each rimfire cartridge case using the apparatus shown in FIG. 1. The premix doses were then compacted into the rims of the cases using the two stage compacting process described above with reference to FIGS. 2 and 3. In the first stage, the radiused steel punch was used at a load of about 40 Kgs. In the second stage, the flat steel punch was used at a load of about 130 Kgs.

About 6.5 microliters of water, at room temperature, containing a suitable agent to reduce its surface tension, were then dosed into each case using the apparatus shown in FIG. 4. The cases were then subjected to reduced pressure in an enclosure for about 20 sedonds and then, under normal pressure conditions, a similar volume of 25%wt/vol shellac in industrial methylated spirit was added to each case. After 10 minutes standing the cases were dried overnight at 40°–60° C. The primed cases were then loaded with propellant and bulleted in the usual way. Of course, in the case of "blank" cartridges the bulleting operation would be omitted.

In the usual sensitivity, ballistic, accuracy and mass explosibility tests the 0.22 rimfire cartridges gave very satisfactory results.

What is claimed is:

1. A method of priming a rimfire cartridge by providing in the rim thereof a quantity of primer comprising a primary explosive compound, said method comprising, in the recited order, the steps of:

(a) dosing into the rimfire case a quantity of a substantially dry, powdery, relatively insensitive premix comprising, in predetermined proportions, at least two materials that will, in the presence of a liquid reaction medium, react together forming said primary explosive compound, (b) compacting the premix so as substantially to fill the rim of the case therewith, (c) dosing a quantity of said liquid reaction medium into said case so as to cause said materials to react together forming the primary explosive compound, and (d) drying the primer.

2. A method according to claim 1 wherein said quantity of premix is compacted by axially advancing a generally cylindrical punch into the case via its open end and into contact with the premix, the forward end of the punch being so shaped that it forces an amount of said premix into the rim sufficient substantially to fill the rim therewith.

3. A method according to claim 2 wherein the forward end portion of the punch is right-circular cylindrical, the transition between the cylindrical surface and the end face of said portion being radiused.

4. A method according to claim 2 wherein said quantity of premix is compacted in two stages, the first stage utilising a punch as specified in claim 3 and the second stage utilising a punch the forward end portion of which is right-circular cylindrical.

5. A method according to claim 1 wherein, after addition of the liquid reaction medium but before drying of the primer, the interior of the cartridge case is subjected to a partial evacuation/air admission cycle to aid impregnation of substantially the whole of the compacted premix with the liquid reaction medium.

6. A method according to claim 1 wherein, after addition of the liquid reaction medium but before drying of the primer, a quantity of a liquid medium containing a film-forming material is dosed into the case whereby, upon drying of the primer, a film of said film forming material forms on the surface of said primer.

7. A method according to claim 6 wherein said film-forming material is shellac.

8. A method according to claim 1 wherein said liquid reaction medium contains a film-forming material whereby, upon drying of the primer, a film of said film-forming material forms on the surface of said primer.

9. A method according to claim 8 wherein said film forming material is an acrylic polymer.

10. A method according to claim 1 wherein said primer is a composition containing said primary explosive compound and one or more other ingredients, the premix containing, in predetermined proportions, said one or more other ingredients in admixture with said materials.

11. A method of priming a rimfire cartridge comprising: dosing into the rimfire case a quantity of a substantially dry, powdery, relatively insensitive premix comprising, in predetermined proportions, at least two materials that will, in the presence of a liquid reaction medium, react together forming said primary explosive compound; then compacting the premix with at least one axially movable punch so as substantially to fill the rim of the case therewith without spinning; then dosing a quantity of said liquid reaction medium into said case so as to cause said materials to react together thereby forming a primary explosive compound in the rim; and then drying the primer.

* * * * *